US006142319A

United States Patent [19]

Kim

[11] Patent Number: 6,142,319

[45] Date of Patent: Nov. 7, 2000

[54] LOCKING DEVICE FOR SECURING GOLF CLUBS

[76] Inventor: Moon Kook Kim, 3210 Sage Rd., Fallbrook, Calif. 92028

[21] Appl. No.: 09/244,665

[22] Filed: Feb. 4, 1999

[51] Int. Cl.[7] ..... A47F 5/00

[52] U.S. Cl. ..... 211/70.2; 211/4; 206/315.2; 206/315.6; 70/58

[58] Field of Search ..... 211/70.2, 4, 163, 211/205, 39, 65, 70.5, 70, 64; 70/58; 206/315.2, 315.6; 280/DIG. 6

[56] References Cited

U.S. PATENT DOCUMENTS

| | | | |
|---|---|---|---|
| D. 379,881 | 6/1997 | Gregg, III et al. | D6/457 |
| 1,717,959 | 6/1929 | Cauffman | 206/315.6 |
| 1,757,600 | 5/1930 | Sprowle | 211/64 |
| 2,024,484 | 12/1935 | Smith . | |
| 4,673,082 | 6/1987 | Hemme | 211/70.2 X |
| 4,753,446 | 6/1988 | Mills . | |
| 5,524,753 | 6/1996 | Murphy . | |
| 5,636,735 | 6/1997 | Stusek . | |
| 5,738,229 | 4/1998 | Fairweather | 211/70.2 |
| 5,918,490 | 7/1999 | Lion | 211/70.2 X |

*Primary Examiner*—Robert W. Gibson, Jr.
*Attorney, Agent, or Firm*—Lyon & Lyon LLP

[57] ABSTRACT

A locking device for securing golf clubs comprising at least two main elements: a base plate and a locking plate. The base plate has a plurality of notches formed on its outer periphery for receiving the shafts of one or more golf clubs. The locking plate with a plurality of hooks is rotatably mounted on the base plate. A golf club inserted into a notch is retained in place upon rotation of the locking plate. A lock mechanism can be added such that when it is engaged, it locks the plates against rotation.

6 Claims, 4 Drawing Sheets

LOCKING DEVICE FOR SECURING GOLF CLUBS

FIELD OF INVENTION

The present invention relates generally to golf club security devices. More particularly, this invention relates to a golf club security device that secures each golf club separately and individually, and may be used with or without a golf bag for convenient access.

BACKGROUND OF THE INVENTION

It has become increasingly common for single golf clubs to be stolen at golf courses from unattended golf bags. As golf club prices continue to rise, replacement of stolen golf clubs could cost a golfer $500 or more. Although many securing devices are available in the industry, none provides a golfer the needed protection against club theft and, at the same time, user convenience.

For example, U.S. Pat. No. 5,636,735 (Stusek) describes a device comprising three discs having a plurality of vias or holes formed therein. After golf clubs are inserted through the aligned, and thus open, vias, one or more of the discs can then be rotated with respect to a subjacent plate to partially close these holes in order to clamp the club shafts in place. This type of design has at least two limitations: (a) because of the different widths of the club shafts, the uniform size holes would force some of the club shafts to be held too tightly, thus damaging the finish of the club shafts, while others may be loosely held; (b) even if the holes were made of different sizes to accommodate different club shafts, or if a resilient material, such as graphite, were used to protect the shaft finish, the device may be too inconvenient to use or too costly to manufacture.

Another type of security device, such as the one shown in U.S. Pat. No. 5,524,753 (Murphy), holds more than one golf club in a single slot or compartment. This type of design allows golf clubs to be in contact with each other and thus increases the opportunity for the clubs to be damaged.

Accordingly, it is desirable to have a golf club locking device that offers not only the needed protection against theft, but also lower cost and convenience of use.

SUMMARY OF THE INVENTION

The present invention relates to a locking device for securing golf clubs. The invention comprises three main components: a base plate, a locking plate, and a lock mechanism. In the preferred embodiment of the present invention, the base plate contains a plurality of notches formed on its outer periphery, with each notch having an inner compartment interconnecting to an outer compartment. The locking plate comprises a plurality of hooks formed on its outer periphery and is rotatably mounted on the said base plate, with each hook corresponding to a notch of the base plate. The lock mechanism preferably comprises a ratchet, a toothed arc and a rotation spring, allowing the plates to be rotated with respect to each other and selectively locked in place by the user.

When the locking device is in its open configuration, a golf club shaft extending through the outer compartment of a notch of the base plate can be first "clicked" into the inner compartment of the same notch by pushing the golf club shaft through the compartment junction against a floating ball bearing unit. The golf club can then be further secured by rotating the locking plate relative to the base plate to seal the compartment junction of the base plate notch with the associated hook on the locking plate, thus locking the golf club inside the inner compartment of the base plate. The lock mechanism can then be engaged to lock the base and locking plates in their secured position against rotation.

DETAILED DESCRIPTION OF THE PREFERRED EMBODIMENTS

Figure 1:
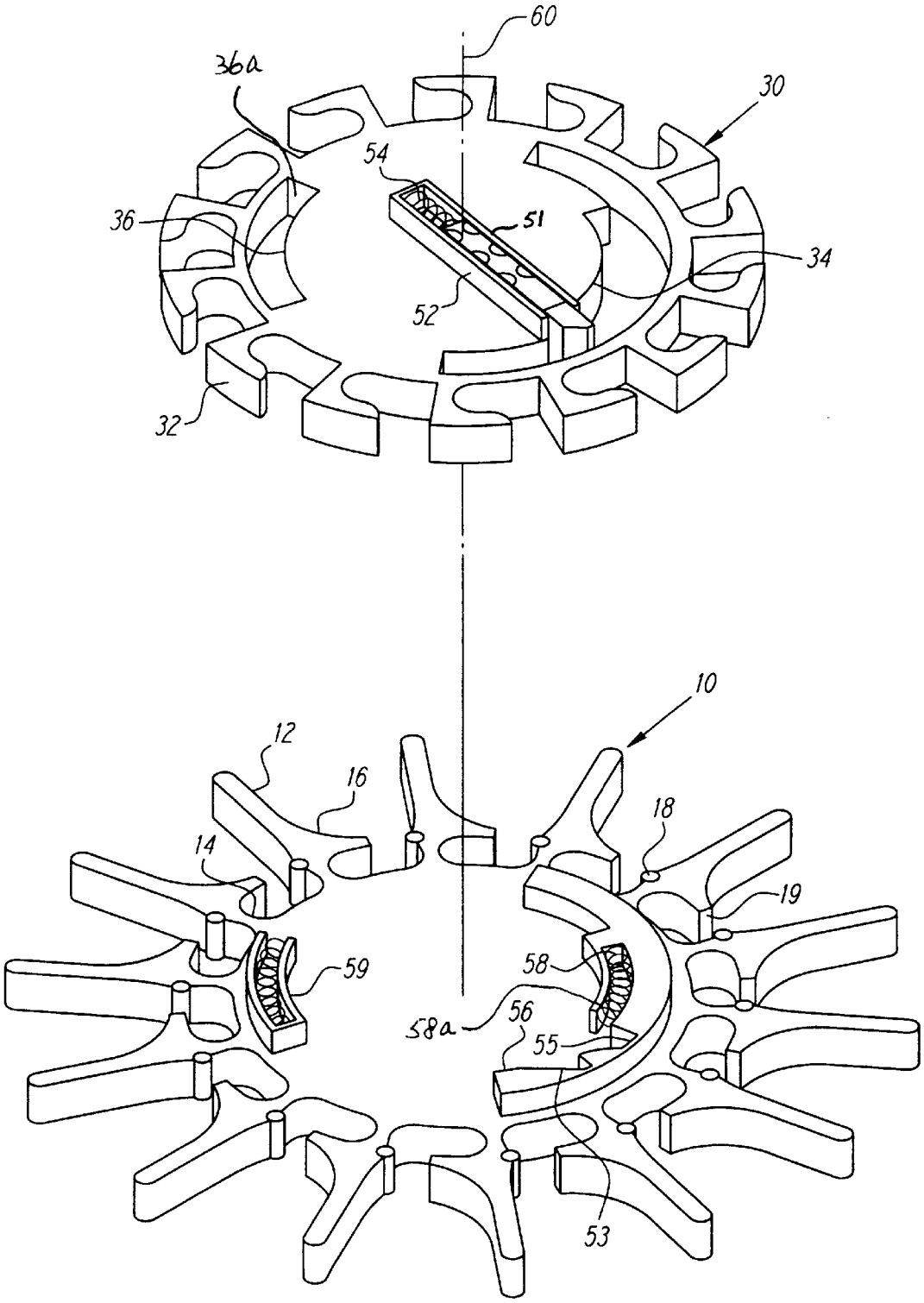
FIG. 1 is an exploded perspective view of a locking device for securing golf clubs in accordance with the present invention.

FIG. 1 is an exploded perspective view of the preferred embodiment of the golf club security device of the present invention. The golf club security device comprises a base plate 10 and a locking plate 30, wherein the locking plate 30 is rotatably mounted on the base plate 10 along the central axis 60 of the plates. The golf club security device also comprises a lock mechanism, the components of which are preferably mounted either on the base plate 10 or the locking plate 30. In the preferred embodiment, the locking device is mounted in a golf bag, providing a cover for the mouth of the bag.

Figure 2A:
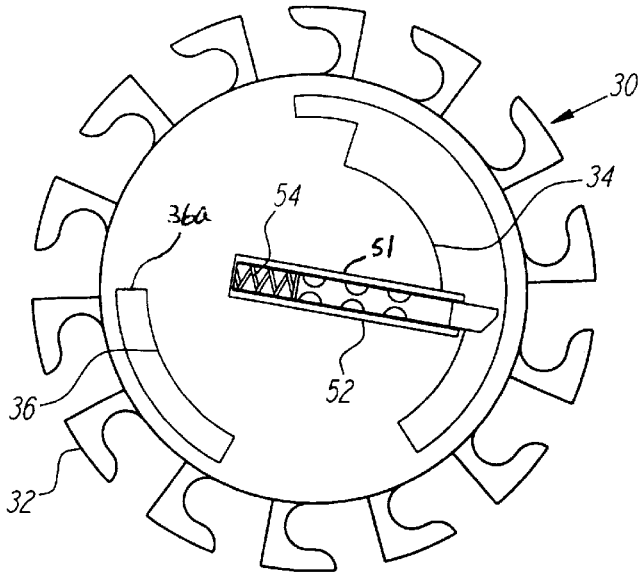
FIGS. 2*a* and 2*b* are, respectively, top views of a locking plate and a base plate in accordance with the present invention, showing the components of the lock mechanism.
Figure 2B:
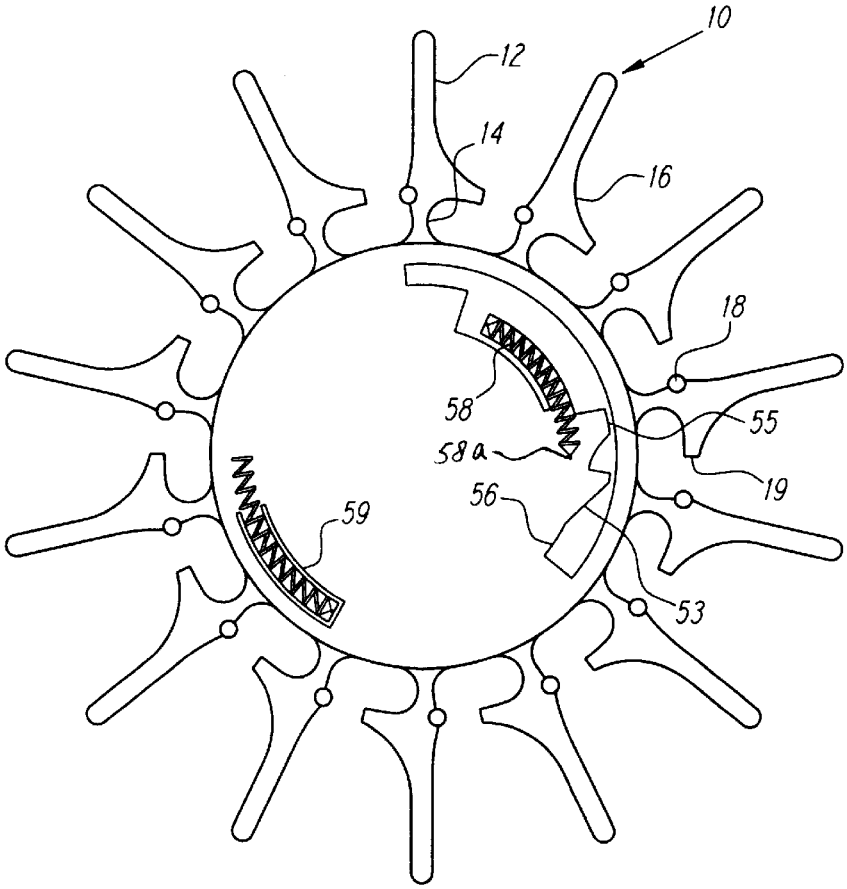

Turning now to FIG. 2*a* and 2*b*, the base plate 10 comprises a plurality of notches 12 formed on its outer periphery, with each notch 12 having an inner compartment 14 interconnecting to an outer compartment 16. The base plate 10 further comprises a plurality of retractable units 18, such as floating ball bearings, placed at the junction 19 of the two compartments 14 and 16 of a notch 12. Each of the retractable units 18 can be pushed into a hidden pocket in the base plate (not shown) when force is applied against the outward facing surface of the retractable unit 18, but returns to its initial position when that force is withdrawn. Accordingly, the retractable units 18 allow golf club shafts to pass through the compartment junctions 19 with the application of a small force.

The locking plate 30 comprises a plurality of hooks 32 formed on its outer periphery, with each hook 32 corresponding to a notch 12 of the base plate 10. The locking plate 30 further contains an arcuate slot 34 and a spring slot 36 corresponding to a toothed arc 56 and a rotation spring element 59, respectively, of a lock mechanism, which will be described with further details below.

The shapes and dimensions of the base and locking plates 10 and 30 depend largely on the shape and size of the opening of the host golf bag. That is, the base plate 10 and the locking plate 30 generally conform to the shape and size of the opening of the host golf bag. Since most of the golf bags have a circular or oval opening, the base plate 10 and the locking plate 30 are generally in the shape of a disc. The dimensions of the base plate 10 are preferably such that the outer perimeter of the base plate 10, formed by the outer arcs of its notches 12, either approximates or is smaller than the dimension of the opening of the host golf bag. The base plate 10 generally contains fourteen notches 12 to accommodate the USGA standard golf club set. Of course, the number of notches may be varied based on one's preference or need. The diameter or width of the locking plate 30 may be varied, depending on the desired size of the notches 12 of the base plate 10.

A great variety of materials may be used to fabricate the base plate 10 and locking plate 30. Generally, however, strong and durable, yet light materials are preferred. In this regard, the base plate 10 and locking plate 30 may be made of plastic or polymeric materials, such as a molded injection plastic or Delrin®, a polymeric material. The plates may also be made of light metals such as aluminum.

Referring again to FIGS. 2*a* and 2*b*, the ratchet casing 51, the ratchet 52, the ratchet spring 54, the toothed arc 56, the locking spring 58, and the rotation spring element 59 together operate as a lock mechanism. The ratchet casing 51 encases the ratchet 52 and the ratchet spring 54 such that the ratchet 52 is retractable against the ratchet spring 54. The ratchet casing 51, ratchet 52 and the ratchet spring 54 are integrally mounted on the locking plate 30. The rotation spring element 59 and the toothed arc 56 containing the locking spring 58 are mounted on the base plate 10.

When the locking plate 30 is mounted on the base plate 10, the toothed arc 56 containing the locking spring 58 is located in the arcuate slot 34, with the ratchet 52 engaging either the first groove 53 or the second groove 55 of the toothed arc 56, and the ratchet casing 51 attaching to one end 58*a* of the locking spring 58. Similarly, the rotation spring element 59 is located in the spring slot 36, with one end of the rotation spring element 59 attaching to the corresponding wall 36*a* of the spring slot 36.

Figure 3:
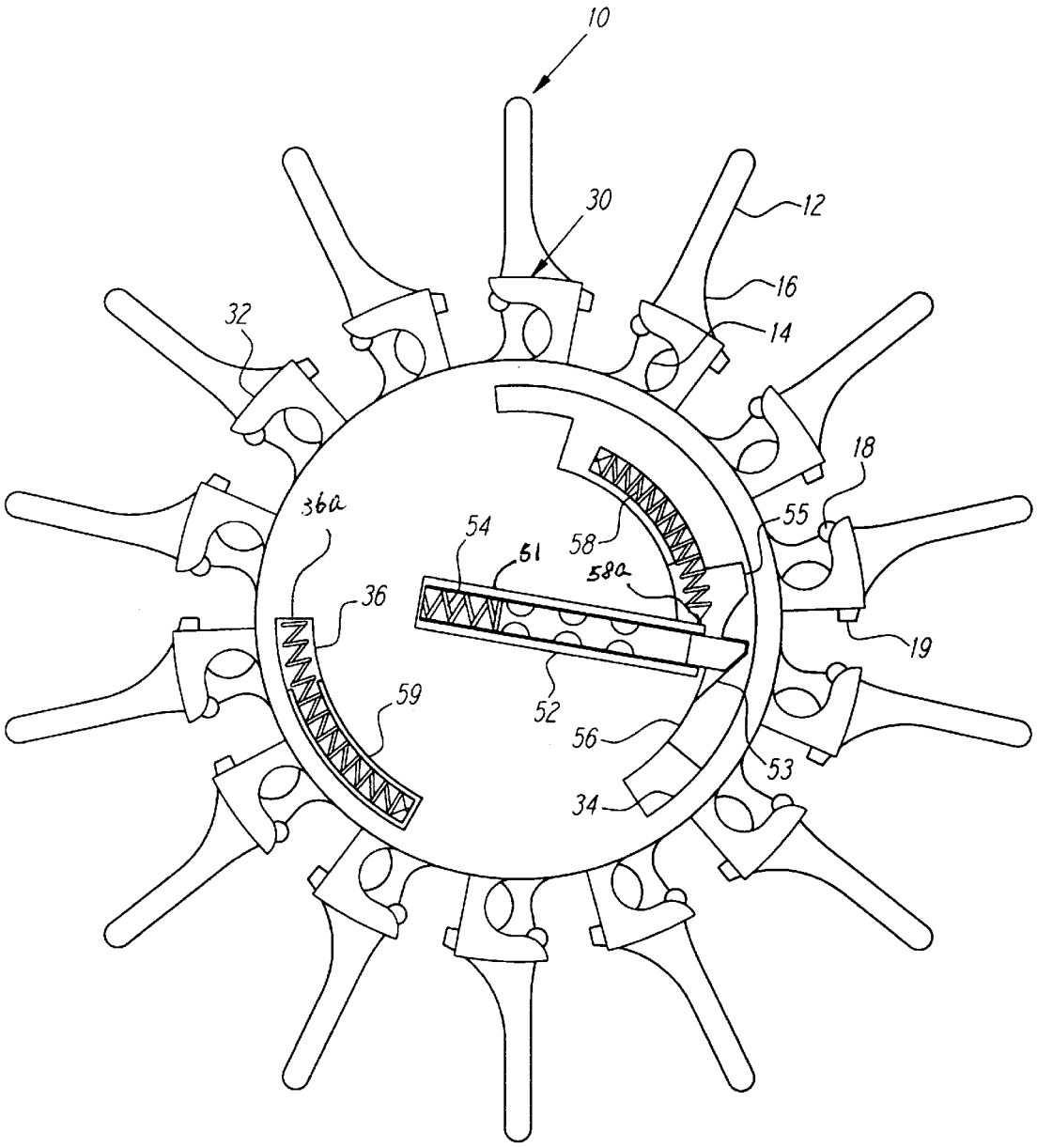
FIG. 3 is a top view of a locking device for securing golf clubs in accordance with the present invention, shown in the open configuration.

When the lock mechanism is in its open configuration (as shown in FIG. 3), the ratchet 54 rests in the first groove 53 of the toothed arc and the locking spring 58 is stretched. The rotation spring element 59 is similarly stretched. In this mode, a golf club shaft extending through the outer compartment 16 of a notch 12 of the base plate 10 can be "clicked" into the inner compartment 14 of the same notch 12 by pushing the golf club shaft through the compartment junction 19 against the retractable unit 18. The golf club is thus rigidly held within the inner compartment 14, and force is needed to pull the club out of the inner compartment 14 via junction 19.

Figure 4:
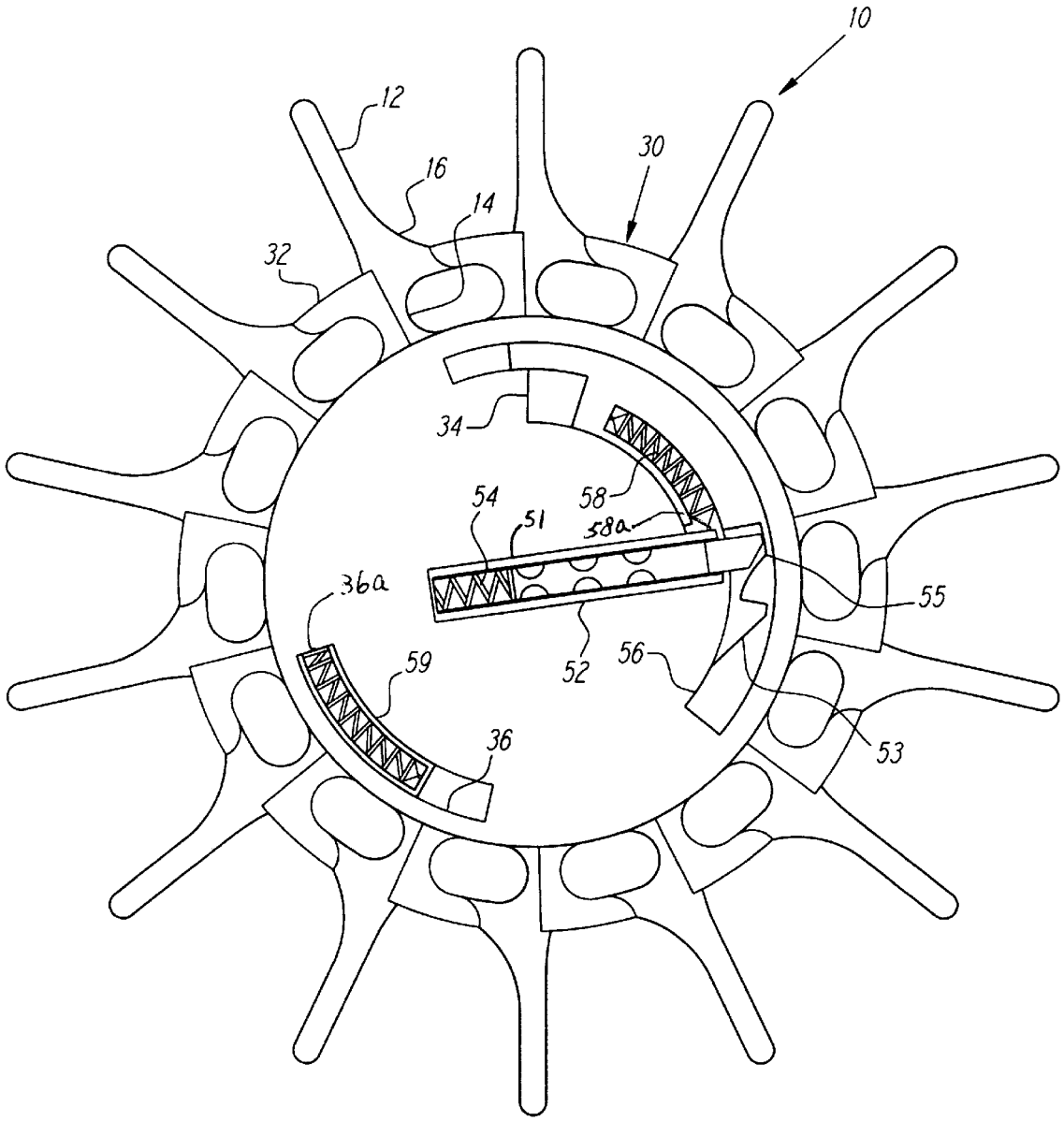
FIG. 4 is a top view of a locking device for securing golf clubs in accordance with the present invention, shown in the secured configuration.

A golf club can then be further secured by engaging the lock mechanism into its secured configuration. This is done by first manually retracting the ratchet 52 out of the first groove 53 of the toothed arc 56. The locking plate 30 is then rotated relative to the base plate 10 so that the ratchet 52 can be positioned into the second groove 55 of the toothed arc 56. The locking spring 58 and the rotation spring element 59 also retract back into their relaxed state to help positioning the ratchet 52 into the second groove 55. When the ratchet 52 is so positioned, the compartment junctions 19 of the base plate notches 12 are sealed with the associated hooks 32 on the locking plate 30. A lock (not shown), such as a combination lock, can then be used to lock the ratchet 52 so that it cannot be retracted out of the second groove 55 of the toothed arc 56. The base plate 10 and the locking plate 30 are thus locked in place against rotation. The security device is thus locked in its secured configuration as shown in FIG. 4.

While embodiments of the present invention have been shown and described, various modifications may be made without departing from the scope of the present invention, and all such modifications and equivalents are considered to be included within the scope of the present invention.

For example, in an alternative embodiment (not shown), the base plate may comprise a plurality of notches formed on its outer periphery, with each notch having only a single compartment for the shaft of a golf club to be inserted therein. When the lock mechanism is engaged into its secured mode, however, the locking plate is rotated with respect to the base plate such that a hook on the locking plate divides its corresponding notch on the base plate into two compartments. As such, the hook seals the golf club shaft in a separate and enclosed compartment. The secured configuration for this embodiment thus looks similar to that which is shown in FIG. 4.

In another embodiment (not shown), the lock mechanism is mounted between the base plate and the locking plate.

In still another embodiment (not shown), the locking device is mounted into a golf bag such that the diameter or width of the plates of the device is smaller than that of the golf bag.

What is claimed is:

1. A locking device for securing golf clubs, comprising:

a base plate having a plurality of notches formed on its outer periphery; and a locking plate rotatably attached to said base plate, said locking plate having a plurality of hooks formed on its outer periphery, wherein each of the plurality of notches of said base plate contains an inner compartment interconnecting to an outer compartment.

2. The locking device of claim 1, further comprising a plurality of retractable units, wherein a retractable unit is mounted in a slot formed at the junction of the inner and outer compartments of a notch.

3. The locking device of claim 1, further comprising a lock mechanism for selectively securing said locking plate against movement relative to said base plate.

4. The locking device of claim 1 wherein each of the hooks on the locking plate divides an associated notch of the base plate into an inner compartment and an outer compartment when the locking device is engaged into a secured configuration.

5. The locking device of claim 1, further comprising a lock mechanism.

6. The locking device of claim 1, wherein the locking device is mountable to a golf bag.

* * * * *